United States Patent [19]

Haller et al.

[11] Patent Number: 4,466,989

[45] Date of Patent: Aug. 21, 1984

[54] HORIZONTAL MOBILITY IN FLUIDIZED BEDS

[75] Inventors: Albert H. Haller, Dunwoody, Ga.; Eckart F. Schutz, Richmond, Va.

[73] Assignee: AT&T Technologies, Inc., New York, N.Y.

[21] Appl. No.: 497,989

[22] Filed: May 25, 1983

[51] Int. Cl.[3] ..... B05D 1/22; B05C 19/02

[52] U.S. Cl. ..... 427/185; 427/97; 118/421; 118/429

[58] Field of Search ..... 118/421, 429, DIG. 5; 427/185, 213, 97; 366/114, 115

[56] References Cited

U.S. PATENT DOCUMENTS

| | | | |
|---|---|---|---|
| 3,196,033 | 7/1965 | Brooks | 427/185 X |
| 3,254,625 | 6/1966 | Armstrong | 427/185 X |
| 3,520,711 | 7/1970 | Bish et al. | 427/185 |
| 3,593,678 | 7/1971 | Miller | 118/630 |
| 4,224,090 | 9/1980 | Garner | 156/48 X |

FOREIGN PATENT DOCUMENTS

| | | |
|---|---|---|
| 240989 | 11/1968 | U.S.S.R. . |
| 295673 | 11/1968 | U.S.S.R. . |
| 560647 | 10/1975 | U.S.S.R. . |

*Primary Examiner*—Shrive P. Beck
*Attorney, Agent, or Firm*—D. C. Watson

[57] ABSTRACT

Articles such as printed wiring board substrates (10) often having hundreds of tiny through-bores are coated with particles (76) in fluidization apparatus (55). Such apparatus (55) includes a base (56) having a frame (61) to receive reciprocation forces applied to an arm (65) and to transmit the same to a fluid bed assembly (68). Assembly (68) includes a plenum (71) for distributing gas, a holder (75) for a bed of particles made fluid-like by gas diffusing therethrough and columns (69) for supporting a work chamber (85). Connected to the bed assembly (68) is the chamber (85) having sidewalls (86–89) formed sufficiently strong to uniformly distribute horizontal vibratory forces thereover. Vibrators (91 and 92) are mounted to opposing sidewalls (88 and 89), respectively, to apply horizontal forces against such sidewalls and gases therebetween. Sidewalls (86–89) are advantageously isolated from assembly (68) sufficiently that the horizontal forces are substantially contained in and uniformly distributed over sidewalls (88 and 89) and gases therebetween. Horizontal mobility is thereby imparted to the gas-borne particles (76) to a degree dependent upon optional adjustment of the vibrators (91 and 92).

12 Claims, 7 Drawing Figures

HORIZONTAL MOBILITY IN FLUIDIZED BEDS

TECHNICAL FIELD

This invention relates to coating at least one surface of an article with particles in a fluidized bed. More particularly, in coating some articles, horizontal mobility of fluidized particles is desirable to coat features limited to horizontal access, and this invention relates to improving such mobility.

BACKGROUND OF THE INVENTION

Fluidized bed work involves a gas-solid contacting process in which a bed of particles is lifted, agitated and thus enlarged by rising streams of gas. The amount of lifting and enlargement relates to the gas velocity, the size and weight of the particles and the density of their dispersion throughout the gas. For coating work the particles are typically fine, light in weight and densely dispersed, the gas velocity is low and the bed is enlarged to accommodate the size of article to be coated. At low velocities utilized in coating work, the bed behaves as a slowly boiling liquid, hence the term "fluidized bed."

Perhaps the most pervasive problem in this art is to obtain and maintain good agitation and uniform dispersion of particles throughout a work chamber enclosing a fluidized bed. Nearly all beds are supported on a substantially horizontal member which is also utilized as a gas diffuser. A compressed gas is introduced under and diffused through the member and the bed to create a dense cloud of gas-borne particles above the member. A problem is that large bubbles of gas are created which rise through the bed and erupt on the top surface like bubbles in a boiling liquid. Such vigorous bubbling is to be corrected because it causes uneven coating and such correction is typically achieved by vibrating the bed. When satisfactory vibration is accomplished, uniformly sized pores appear between particles which may align somewhat uniformly into fine channels for gas to move upwardly. Unfortunately, when obstructions are incurred by the gas, undesirable turbulence may ensue so chamber sidewalls are preferably made smooth and vertical, especially for difficult work.

The bed conditions obtained by conventional means are adequate for most coating work. For example, articles are heated and then immersed in such beds and corrosion resistant polymers are deposited on the articles in coatings of spark resistant, satisfactory thickness. However, many articles have irregular features including lateral indentations which require lateral mobility (usually horizontal) of particles for proper coating. Typical articles requiring horizontal mobility are printed wiring board substrates which may have hundreds of tiny through-bores which are to be uniformly, internally coated. Coating such substrates is a challenging task.

Other problems are present in fluidized beds which are vibrated by conventional means. For example, thicknesses of coatings can be expected to range from about $\pm 4$ to $\pm 5$ mils of a given value whereas $\pm 1\frac{1}{2}$ mil is a desired tolerance. High overall bed densities are difficult to achieve due to gradients in density over such beds making them inefficient in coating articles. In-process addition of particles often disturbs conventional bed operation. It is believed that many of these problems are at least mitigated by improving horizontal mobility of particles in a bed. It is further believed that such mobility is often discouraged by inefficient and non-uniform vibration of fluidized beds.

Vibration has been achieved by mechanical cranks, electro-magnetic oscillators, and by pneumo-oscillators (pulsing air mechanisms). These expedients have been applied to the bed support member to the walls of the work chamber or both. Sometimes they have been applied to work chambers having portions of the walls made of elastic material to assist or magnify applied vibrations. When vibrators have been applied directly to sidewalls, the intention and the effect has been to vibrate the gas and gas-borne particles disposed between the sidewalls.

Some of the above expedients impart forces having horizontal components which assist in driving particles into indentations in articles. However, such forces are seen to be heretofore applied in a non-uniform manner between and along opposing sidewalls. Also, the horizontal components of forces have been relatively uncontrolled in causing particle movement. For example, lateral excursion of particles often have been too long, causing turbulence in some parts of a bed, and too short to penetrate bores in other parts of the same bed.

Accordingly, it is desirable to develop new and improved expedients for providing horizontal mobility of particles in a fluidized bed. Such mobility should be provided without creating large bubbles and turbulence. It is further desirable to impart to particles, horizontal mobility which is uniformly distributed over and between opposing sidewalls. Such mobility should be adjustably limited to horizontal particle excursions required by the work to avoid turbulence in a bed.

SUMMARY OF THE INVENTION

At least one surface of an article may be coated with particles utilizing a fluid bed assembly supported on a base. The assembly includes a plenum for distributing gas, a holder for a bed of particles made fluid-like by gas diffusing therethrough and supports for a work chamber. The work chamber being supported has sidewalls connected to the bed assembly which are formed sufficiently strong to uniformly distribute horizontal vibratory forces over such sidewalls. At least one pair of opposing sidewalls are vibrated by applying horizontal forces against the sidewalls and gases therebetween. The sidewalls are advantageously isolated from the bed assembly sufficiently that the horizontal forces are substantially contained in and uniformly distributed over the pair of sidewalls and gases therebetween. By vibrating and isolating such sidewalls, horizontal mobility is imparted to gas-borne particles in the chamber.

BRIEF DESCRIPTION OF THE DRAWING

The invention will be more readily understood from the following detailed description thereof when read in conjunction with the accompanying drawing wherein.

Figure 1:
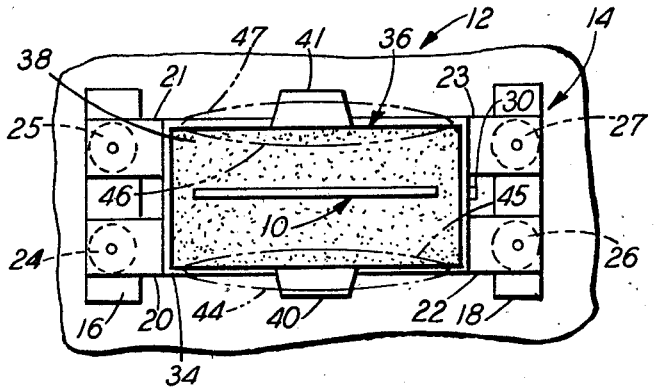
FIG.-1 (PRIOR ART)
FIG. 1 is a simplified plan view of prior art fluid bed apparatus with an article immersed therein and stroboscopic lines to indicate a pattern of vibration in opposing sidewalls.

It can be seen that some elements in the figures are abbreviated or simplified to highlight certain features of the invention. Also, where appropriate, reference numerals have been repeated in the figures to designate the same or corresponding features in the drawing.

DETAILED DESCRIPTION

The Articles And Particles

Figure 2:
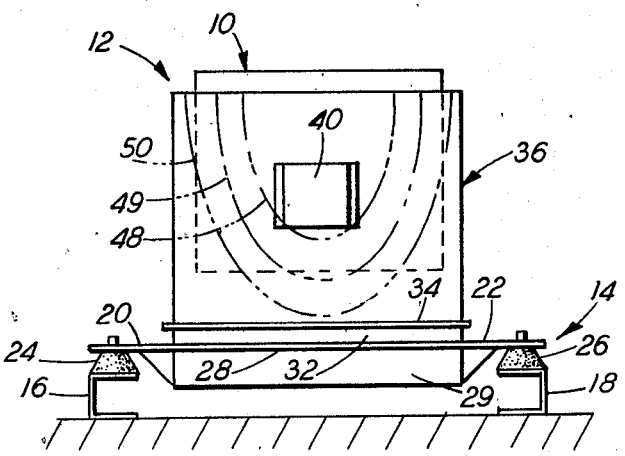
FIG.-2 (PRIOR ART)
FIGS. 2 and 3 are simplified front and side elevation views, respectively, of the apparatus shown in FIG. 1, further indicating vibration lines.
Figure 3:
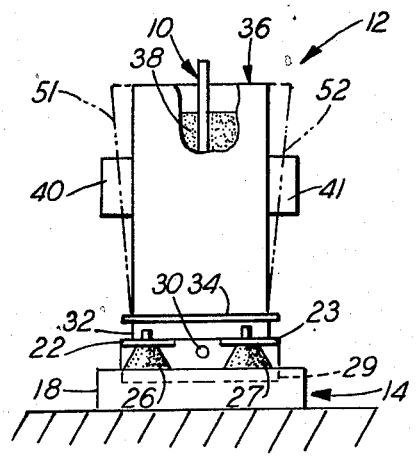
FIG.-3 (PRIOR ART)

FIGS. 1, 2 and 3 illustrates a typical article 10 which may be coated in the practice of the invention. For purposes of illustration and discussion, such article 10 is selected from a class of printed wiring (or printed circuit) board substrates known in the art and further referred to herein merely as substrates 10.

Such substrates 10 are not limited to any particular size or configuration although for discussion it will be assumed that they are from about 3"×8" to about 18"×24" in height and length, respectively. The material may be a metal such as steel, aluminum, invar or brass or a non-metal. For example, historically substrates 10 were often made of a paper laminated with a phenolic coating. More recently, a glass fiber fabric has been utilized and bound with an epoxy or a polyester resin.

The coatings also are many and varied. For example, most common polymers have been utilized including some sophisticated epoxy compounds. Currently, metal substrates 10 are often coated with an epoxy formulated by Polymer Corporation of Reading, Pa. and sold under the trade designation Corvel ECA 1283. Epoxy-glass substrates 10 may be coated with a rubber modified epoxy.

The thickness of substrates 10 and the depth of coatings also vary considerably but, for electronics work, the aim is usually to obtain a coated substrate 10 having a thickness of about 1/16 inch (typically 60–66 mils). A metal substrate 10 may be about 30–40 mils thick and receive a coating of about 10–15 mils each side for a total of about 60 mils. An epoxy-glass substrate 10 may be about 60 mils thick and receive about 3 mils of coating each side for a total of about 66 mils. Conventionally, the tolerance of such coatings was expected to be about ±4 to ±5 mils by a fluidized bed process. By the practice of the invention a tolerance of about ±1½ mil is readily obtained and a tolerance of about ±½ mil may be achieved under normally good conditions.

Achieving such uniform coatings over large substrates 10 is a desirable objective. However, it is even more challenging to uniformly coat, in a continuous manner, features which are limited to lateral accessibility. For example, a substrate 10 may have hundreds of through-bores ranging from about 60–70 mils in diameter. When such a substrate 10 is disposed in the manner shown in FIGS. 1, 2 and 3, the through-bores require substantially horizontally directed movement of coating particles to penetrate into the bores and deposit on the surfaces therein.

Horizontal mobility of coating particles is achieved by many means including a selection of particle size to facilitate particle mobility. For example, when a rubber modified epoxy is used, the particles may range from about 38 microns to about 180 microns as measured by standard sieves. For the Corvel 1283 epoxy the particles may be slightly larger, ranging up to about 200 microns in size. Of course, most coating powders also include additives for fluidization control, a curing agent and pigments. Good horizontal mobility is further achieved by proper supply and distribution of a particle diffusing gas (fluidizing gas) and adequate vibration of the fluidized bed.

Prior Art Apparatus

FIGS. 1, 2 and 3 illustrate prior art apparatus 12 for coating substrates 10 utilizing prior art vibration techniques for enhancing mobility of particles. Apparatus 12 includes a base 14 having channel frame members 16 and 18, support members 20–23 and isolation mounts 24–27.

Members 20–23 may be extensions of a peripheral lower flange 28 attached to a plenum compartment 29 for receiving and distributing fluidizing gas from an inlet 30. On top of flange 28, a member 32 resembling a thick plate is supported which is at least strong enough to support up to about 200 lbs. of resin powder in the illustrated embodiment. Member 32 also functions as a diffuser for the fluidizing gas which often is compressed air although it could be an inert gas such as nitrogen if oxidation of articles or coatings is a problem.

On top of flange 28 and diffuser member 32 another flange 34 is provided to attach a work chamber 36. In the illustrated embodiment of the prior art, it is assumed that a work chamber 36 about 12 inches wide by about 38 inches long by about 30 inches deep is appropriate to accommodate the work. A hanger could be utilized for suspending many substrates at once but for illustrative purposes it will be assumed that only one substrate 10 is suspended as shown and it is about 40 mils thick by about 18 inches high by about 24 inches long.

When compressed gas is introduced into plenum 29 by known means and a typical epoxy compound described previously is loaded onto diffuser member 32, particles 38 thereof will become gas-borne in a mass which typically enlarges to a height preferably about 6 inches below the top of chamber 36. This mass, whether it be compressed or enlarged, is referred to herein as a bed. Of course, when it is referred to as a fluidized bed it is assumed to be at least somewhat enlarged by air entrainment whereby it appears to flow. Although good control is possible, there always seems to be some particles 38 which escape and are drawn off by a peripheral exhaust system (not shown).

To improve the gas entrainment and mobility of particles 38 within chamber 36, it is conventional to vibrate portions of apparatus 12. Consequently, electromagnetic vibrators 40 and 41 are shown mounted on opposing sidewalls and electrically energized while the gas is flowing. In a conventional manner, the vibrations pass into the gases between the sidewalls and vibrate the gas-borne particles 38. Some of the vibrational energy passes into the bed member 32, the air plenum 29 and the base 14.

Unfortunately such conventional vibrating does not spread uniformly over the bed. To investigate distribution of the vibrations stroboscopic light has been focused on the sidewalls. Lines 44–47 in FIG. 1 show the extent of movement of the sidewalls which are vibrated and they indicate arcuate movement with nodes appearing near the corners. Lines 48–50 in FIG. 2 and lines 51 and 52 in FIG. 3 show there is much more movement at the top than at the bottom of the sidewalls. Such non-uniform movement means that horizontal excursions taken by particles is small at the bottom and corner portions of the sidewalls and large at the top middle portions. In fact, almost no movement of particles due to direct vibration is indicated at the bottom corner portions. It is known that such non-uniform distribution of vibration causes non-uniform excursions by particles 38 laterally of the bed. Consequently, features such as through-bores in the article 10 tend to receive coating if they are located at the middle but not if they are located at the ends of each article 10. Moreover, in an effort to provide coating over an entire article 10, some areas are vibrated too much and excess lateral movement of the particles 38 tends to cause counterproductive turbulence in the bed.

Improved Apparatus

Figure 4:
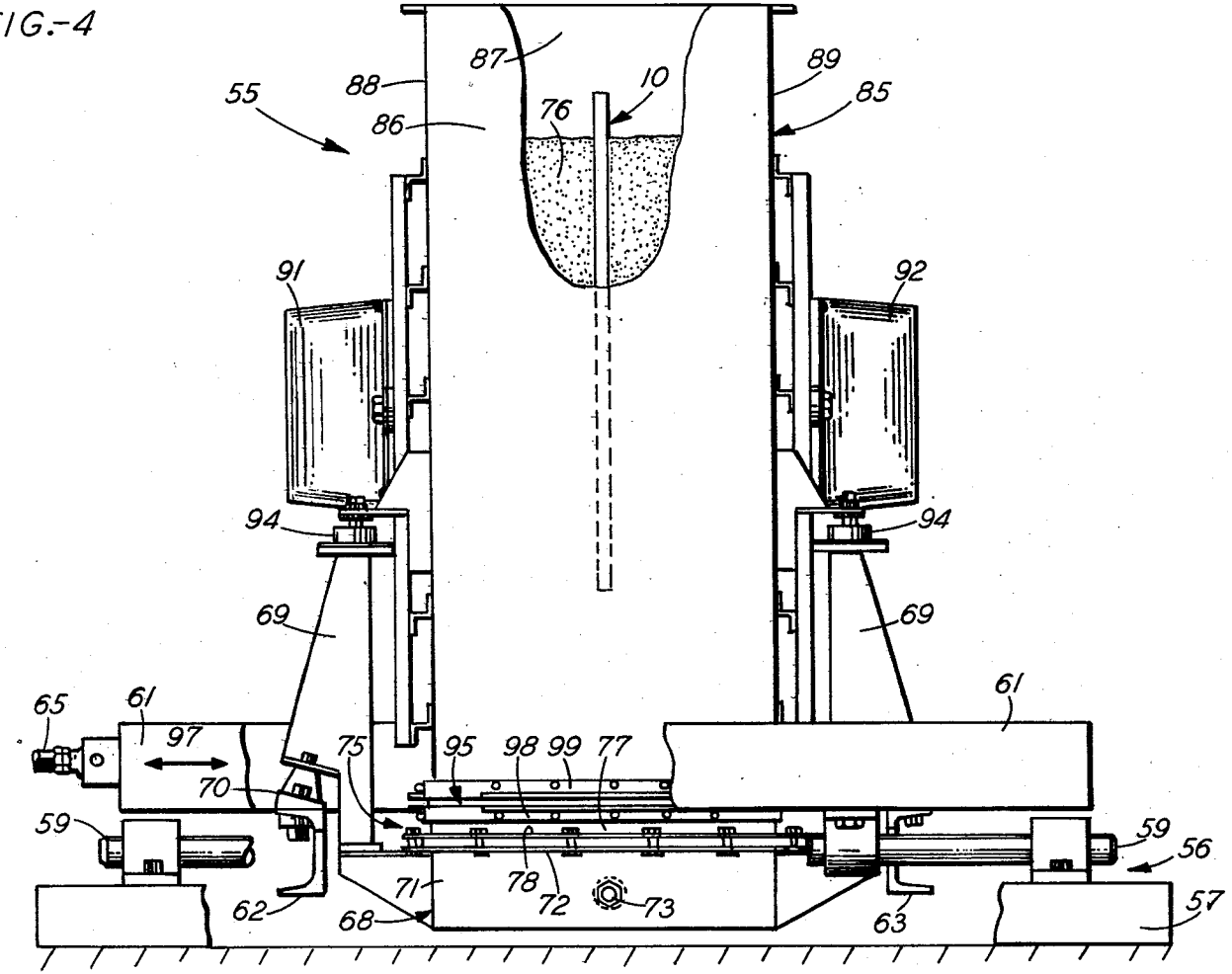
FIG. 4 is a partially cut away, side elevation view of fluid bed apparatus according to the present invention.
Figure 5:
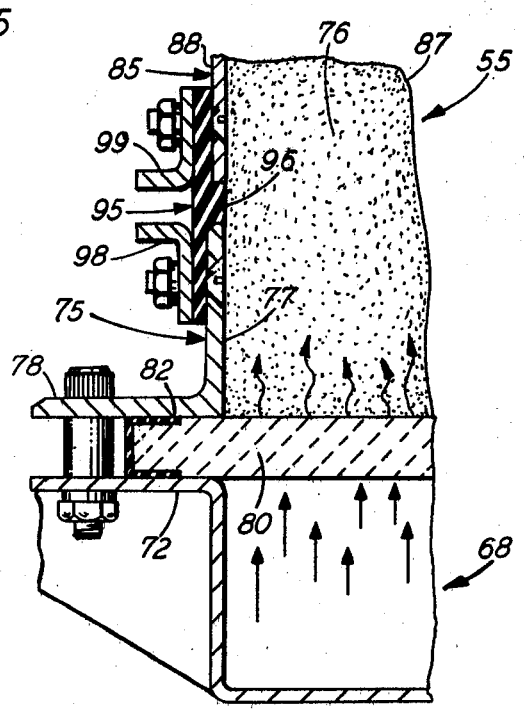
FIG. 5 is a cross-sectional view of part of the apparatus shown in FIG. 4.

FIGS. 4 and 5 illustrate improved apparatus 55 which includes expedients for solving problems noted in the prior art. Apparatus 55 includes a base 56 having end channels 57 and 58 (channel 58 is hidden) similar to, but longer than, channels 16 and 18 shown in FIGS. 1–3. Channels 57 and 58 support sliding rails 59 and 60 (rail 60 is hidden) and support blocks for a channel frame 61 which surrounds apparatus 55. Frame 61, from its underside, supports two longitudinal channels 62 and 63 which complete the major support structure for apparatus 55. A push-pull arm 65 is attached to one side of frame 61 and arm 65 is reciprocated by a crank and motor (neither shown) to rock a major portion of apparatus 55 when a bed is to be properly fluidized.

Apparatus 55 further includes a fluid bed assembly designated generally by the numeral 68. Assembly 68 is supported on channels 62 and 63 of base 56 at each of four corner locations via a column typical of column 69 and two flexible isolation mounts typical of mount 70 shown in FIG. 4. Assembly 68 further includes an air plenum compartment 71 having a peripheral flange 72. Plenum 71 distributes compressed gas introduced from a source (not shown) into inlet 73.

As best shown in FIG. 5, assembly 68 also includes a holder 75 for a bed of particles 76 made fluid-like by gas diffusing through such particles. For purposes of illustration and discussion, holder 75 includes a peripheral wall 77 and a flange 78 holding a substantially horizontal member 80 which is strong enough to support at least about 200 lbs. of coating particles 76. Member 80 is also selected of a material such as a glass beaded filter having pores sized to diffuse a fluidizing gas without retaining particles 76 in such pores. Because of a pressure differential over member 80, a sealing gasket 82 is installed between flanges 71 and 78.

Overhead of assembly 68, a work chamber is installed designated generally by the numeral 85. Chamber 85 is about 12 inches wide by about 38 inches long by about 30 inches deep, similar in size to chamber 36 shown in FIGS. 1–3 for the prior art. The sidewalls are made especially flat and smooth internally and are formed sufficiently strong to uniformly distribute horizontal vibratory forces over their length and breadth. Such strength is inherent in the plate spanning the 12 inch width of the end walls 86 (FIG. 4) and 87. However, the major opposing sidewalls 88 and 89 (FIG. 4) require reinforcing "Z" shaped horizontal strips and vertically extending channels for reinforcement.

It will be appreciated that the major opposing sidewalls are most instrumental in moving laterally and causing particle movement because they extend parallel to and along an article 10. Consequently, sidewalls 88 and 89 are selected to be vibrated by applying horizontal forces thereagainst and against gases disposed therebetween. Electromagnetic vibrators 91 and 92 (FIG. 4) are selected for applying the horizontal forces and such vibrators may be those designated as 30P by Eriez Magnetics, Eriez Manufacturing Co., of Erie, Pa. The vibrators 91 and 92 preferably are wired and operated in synchronization so that each opposing sidewall 88 and 89 moves in the same direction at the same time. A variable voltage control is provided to adjust the force applied at the frequency provided, normally 50 to 60 cycles.

It will be noted that the bed assembly 68 is to some degree isolated from base 56 by isolation mounts typified by mount 70. Such mounts may be those designated as T22-3 Vibration Isolators (8 required) and sold by the Vibration Eliminator Company, Long Island City, New York, N.Y. Mounts 70 are used in compression and they support the entire weight of the fluidized bed assembly 68 and work chamber 85. It was believed, at least until recently, that such minimal isolation was sufficient in the work. This belief was grounded in the fact that any vibratory forces applied to the sidewalls or to push-pull arm 65 was felt throughout the working parts of the bed assembly and, therefore, was not wasted. However, it is now known that such gross vibration is not efficient enough, especially when coating articles 10 having features which require horizontal access for coating particles. The investigations, especially those with stroboscopic light, have shown that conventional vibration with conventional isolation is often wasteful of energy.

Referring now to FIGS. 4 and 5, it is seen that work chamber 85 is connected to the fluid bed assembly 68 at columns 69 and at wall 77 of the bed holder wall 75. In accordance with the teachings of the invention, the work chamber should be isolated from other parts and vibrated as a separate entity. Consequently, mounts are selected to permit horizontal motion with minimal dampening at columns 69. The mounts selected for apparatus 55 are #109 S 40 Isolators (4 required) by the above-mentioned Vibrator Eliminator Company and designated by the numeral 94 in FIG. 4.

A different isolating connector 95 can be seen in FIG. 5 which is selected for connecting chamber 85 to bed holder 75 utilizing different criteria. It has been found desirable to have all sidewalls and connections to bed holder 75 include internally substantially smooth surfaces. Accordingly, gas moving upwardly adjacent such surfaces is substantially unimpeded therealong and turbulence of gas-borne particles from side protrusions is thereby avoided.

To internally, smoothly connect bed holder 75 to work chamber 85, a flexible material such as rubber or neoprene is utilized for connector 95 which is bent in the planes of the sidewalls 86–89 to accommodate all corners. Also, connector 95 (FIG. 5) is provided with an internally raised face 96 so the wall plates from the bed holder 75 and the work chamber 85 abut the sides of raised face 96 to obtain a tight fit. Finally, angle flanges 98 and 99 are provided to seal flat portions of connector 95 against the aforementioned plates to seal the bed area and prevent particles 76 from escaping. It is incidentally seen in FIG. 4 that the outstanding legs of the anles forming flanges 98 and 99 and discontinued at the corner areas.

Operation

In operation of apparatus 55, it is found that fluidized bed coating of substrates 10 having hundreds of through-bores is much improved. Bed holder 75 is loaded with particles 76 of a material suitable for the substrates 10 to be coated. A gas such as filtered, dried and compressed air is introduced into plenum 71 at inlet 73 and a pressure of from about 2 to about 15 psig builds up over plate 80 and the bed. A crank and motor system is operated to push and pull arm 65. Base 56 is thus reciprocated according to arrow 97 which is the same horizontal direction so that in which sidewalls 88 and 89 are vibrated. The supports 70 for bed assembly 68 are sufficiently flexible that movement of base 56 causes a rocking movement of particles 76 in the bed. Gas diffusing therethrough entrains such particles 76 and makes them gas-borne.

Figure 6:
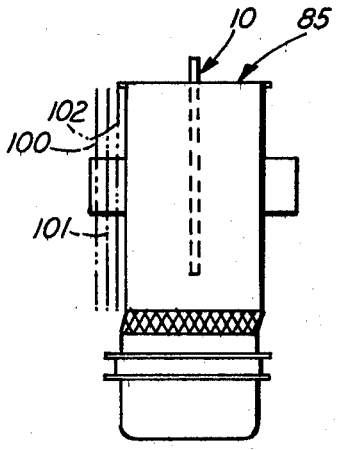
FIGS. 6 and 7 are simplified right biased and left biased end views, respectively, of the apparatus shown in FIGS. 4 and 5 wherein stroboscopic lines are included to indicate a pattern of vibration in accordance with the present invention.
Figure 7:
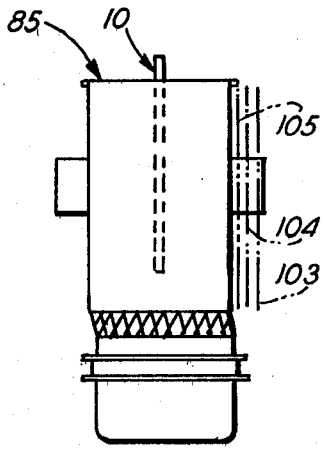

Vibrators 91 and 92 are energized and operated to apply horizontal forces to sidewalls 88 and 89 in a synchronized manner. Such vibrated sidewalls have internal surfaces disposed substantially planar and parallel to each other (and to substrate 10 suspended in work chamber 85). Consequently, during vibration, substantially all opposing points on such sidewall surfaces are equidistant across the chamber 85. By such vibration, gas-borne particles are substantially uniformly driven for a desired distance horizontally by the surfaces vibrating against the gas in the chamber 85. The action of the vibrating sidewalls is best seen in FIGS. 6 and 7 wherein stroboscopic light lines are depicted by lines 100–102 for chamber 85 when it is biased to the right and by lines 103–105 when chamber 85 is biased to the left in the figures. Of course, other features and aspects in operation are readily obtainable and/or apparent to one of ordinary skill in this art.

Other Considerations

Many considerations are of interest which are permitted or enhanced at least in part by the invention. For example, it is found that the particle movement in chamber 85 is so quiescent that ripples or eruptions on the surface are held to within about $\pm\frac{1}{4}$ inch in height. Even the gas flow rate can be held to a very low value of from about 150 to about 250 C.F.H.

Certain benefits are obtained by constructing the sidewalls 86–89 in the manner shown in FIG. 5. The sidewalls 86–89 are made of a thermally conductive material such as metal and are made sufficiently strong by utilizing "Z" members which are external fin-type stiffeners. The material and the fins cooperate to transfer heat to or from the work chamber and externally applied heat transfer media. For example, a fiberglass shroud (not shown) is utilized to confine heated or cooled air passing adjacent to and externally of the sidewalls for heat control. Hot internal temperatures, known to cause turbulence, are often avoided by utilizing cool, dry, compressed air for the fluidizing gas and chilled air is applied for additional cooling externally in the fiberglass shroud.

By the above and other measures, excellent control of particle mobility is achieved. For example, control of vibration amplitude is achieved by a variable transformer control serving the sidewall vibrators. Such a control is sold by the aforementioned Eriez Magnetics under the trade designation Model FT-115. Thus the horizontal displacement of opposing sidewalls 88 and 89 is varied from about 1/64 to 3/64 inch which is found sufficient to cause horizontal excursion of particles 76 into laterally accessible features such as for coating through-bores in the illustrative substrate 10.

It is further found, in the practice of the invention, that in-process additions of particles are readily made without disturbing operation of the bed. For example, by suspending a tuning fork in the bed and monitoring change in its vibration frequency, changes in bed height are sensed and additions of particles 76 are made. In the beds described herein, total bed content of particles 76 have been controlled to within about $\pm\frac{1}{2}$ lb. of a given weight of particles. The improved uniformity of particle distribution in the bed has already been alluded to in reciting the thickness tolerances now achievable at from about $\pm\frac{1}{2}$ to $\pm 1$ mil of a given value. In addition the efficiency of bed coating of particles 76 on a substrate 10 is also so improved that throughput is at least 4 times what was noted with the prior art apparatus 12.

There have been illustrated herein certain practical embodiments of the invention and certain applications thereof. Nevertheless, it is to be understood that various modifications and refinements may be made and used which differ from these disclosed embodiments without departing from the spirit and scope of the present invention.

What is claimed is:

1. Apparatus for coating at least one surface of an article with particles, comprising:

a base;

a fluid bed assembly supported on the base, said assembly including a plenum for distributing gas, a holder for a bed of particles made fluid-like by gas diffusing therethrough and means for supporting a work chamber;

a work chamber having sidewalls connected to the bed assembly and formed sufficiently strong to uniformly distribute substantially horizontal vibratory forces over said sidewalls;

means for vibrating at least one pair of opposing sidewalls by applying substantially horizontal forces against such sidewalls and gases therebetween; and means included in the work chamber support means and sidewall connections for isolating the sidewalls from the bed assembly sufficiently that the horizontal forces are substantially contained in and uniformly distributed over the pair of sidewalls and gases therebetween, thereby imparting horizontal mobility to gas-borne particles in the chamber.

2. Apparatus as in claim 1 wherein the vibrating means further comprises:

means for vibrating a pair of sidewalls in synchronization such that each opposing sidewall in the pair moves in the same direction at the same time.

3. Apparatus as in claim 2 wherein the base further comprises:

means for reciprocating the base in substantially the same horizontal direction as the pair of sidewalls are vibrated; and supports for the bed assembly which are sufficiently flexible that movement of the base causes a rocking movement of particles in the bed to permit gas diffusing therethrough to entrain such particles and make them gas-borne.

4. Apparatus as in claim 2 wherein the work chamber further comprises:

said sidewalls and connections to the bed holder having internally, substantially smooth surfaces such that gas moving upwardly adjacent such surfaces is substantially unimpeded therealong and turbulence of gas-borne particles from sidewall protrusions is thereby avoided.

5. Apparatus as in claim 4 wherein the work chamber further comprises:

said pair of vibrated sidewalls having internal surfaces disposed substantially planar and parallel to each other that during vibration, substantially all opposing points on such surfaces are equidistant across the chamber and gas-borne particles are substantially uniformly driven for a desired distance horizontally by the surfaces vibrating against the gas in the chamber.

6. Apparatus as in claim 5 wherein the work chamber further comprises:

said sidewalls made of a thermally conductive material such as metal and made sufficiently strong by external fin-type stiffeners such that the material and the fins cooperate to transfer heat to or from the work chamber and external heat transfer media.

7. A method of coating at least one surface of an article with particles, comprising:

forming a fluidized bed in an assembly supported on a base, said forming including distributing a gas and supporting a bed of particles made fluid-like by gas diffusing therethrough and into a work chamber;

introducing the article into the work chamber having sidewalls made sufficiently strong to uniformly distribute substantially horizontal, vibratory forces over said sidewalls;

vibrating at least one pair of opposing sidewalls by applying substantially horizontal forces against such sidewalls and gases therebetween; and supporting the sidewalls in an isolated manner at supports from and connections to the bed assembly sufficiently that the horizontal forces are substantially contained in and uniformly distributed over the pair of sidewalls and gases therebetween, thereby imparting horizontal mobility to gas-borne particles in the chamber.

8. A method as in claim 7 wherein the vibrating step further comprises:

vibrating a pair of sidewalls in synchronization such that each opposing sidewall in the pair moves in the same direction at the same time.

9. A method as in claim 8 wherein establishing the base further comprises:

reciprocating the base in substantially the same horizontal direction as the pair of sidewalls are vibrated; and supporting the bed assembly in a sufficiently flexible manner that movement of the base causes a rocking movement of particles in the bed to permit gas diffusing therethrough to entrain such particles and make them gas-borne.

10. A method as in claim 8 wherein the step of forming the fluidized bed further comprises:

moving gas upwardly along connections to the bed holder and along the sidewalls both having internally, substantially vertical surfaces such that gas moving upwardly adjacent thereto is substantially unimpeded therealong and turbulence of gas-borne particles from sidewall protrusions is thereby avoided.

11. A method as in claim 10 wherein the vibrating step further comprises:

vibrating said pair of opposing sidewalls having internal surfaces disposed substantially planar and parallel to each other that during vibration, substantially all opposing points on such surfaces are equidistant across the chamber and gas-borne particles are substantially uniformly driven horizontally by the surfaces vibrating against the gas in the chamber.

12. A method as in claim 11 wherein the introducing step further comprises:

introducing an article for temperature controlled coating into a work chamber having sidewalls made of a thermally conductive material such as metal and made strong by externally radiating fin-type stiffeners such that the material and the fins cooperate to transfer heat to or from the work chamber and external heat transfer media.

* * * * *